United States Patent [19]

Shimomura et al.

[11] Patent Number: 4,745,434

[45] Date of Patent: May 17, 1988

[54] COPYING APPARATUS HAVING PROGRESSIVE CONTROL MEANS

[75] Inventors: Yoshinobu Shimomura; Yoshiaki Takayanagi, both of Yokohama, Japan

[73] Assignee: Canon Kabushiki Kaisha, Tokyo, Japan

[21] Appl. No.: 706,453

[22] Filed: Feb. 27, 1985

[30] Foreign Application Priority Data

Mar. 5, 1984 [JP] Japan ..... 59-42600
Dec. 28, 1984 [JP] Japan ..... 59-276473
Dec. 28, 1984 [JP] Japan ..... 59-276987

[51] Int. Cl.[4] ..... G03G 15/00

[52] U.S. Cl. ..... 355/14 R; 355/14 D; 355/8

[58] Field of Search ..... 355/14 R, 14 D, 14 G, 355/8, 68, 69

[56] References Cited

U.S. PATENT DOCUMENTS 3,708,676 1/1973 Huboi et al. ..... 355/68 X
3,877,413 4/1975 Rowell et al. ..... 355/14 D X
4,304,486 12/1981 Cormier et al. ..... 355/14 D
4,525,059 6/1985 Haramaki ..... 355/8
4,540,279 10/1985 Irie et al. ..... 355/69
4,624,548 11/1986 Takayanagi ..... 355/14 D

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

A copying apparatus or the like having means for scanning the original to form a line image continuously on a photosensitive member, thereby forming an entire image of the original. A photosensor is provided to scanningly detect the density of the original at each phantom segment of the original. Each segment of the original is reproduced under an image forming condition determined on the basis of the density of the segment of the original detected by the photosensor so that the original is reproduced under the image forming condition which is proper for each of the segments. The image forming condition for one of the end segments with respect to the direction of the scanning operation, however, is not determined on the basis of the existing or detected density, but is predetermined or determined independently of the existing or detected density of that segment, so as to provide a clear image at the area corresponding to the end. The similar control may be applied to the other end segment, too.

26 Claims, 16 Drawing Sheets

COPYING APPARATUS HAVING PROGRESSIVE CONTROL MEANS

BACKGROUND OF THE INVENTION

The present invention relates to a copying apparatus wherein an image corresponding to an original is formed under the conditions or parameters controlled in accordance with the nature of the original. More particularly, the present invention relates to a copying machine printer or the like.

U.S. Pat. No. 2,956,487 discloses that a reproduced image is improved by controlling the image formation in response to detection of a quantity of light or a surface potential which may be representative of the density of the original. There are some other proposals in this respect after the above U.S. Patent.

In a copying apparatus, an image is formed on the photosensitive drum with the scanning caused by the relative movement between the original and an optical system including an illumination lamp. During such an image forming process, an image forming condition may be automatically changed. More particularly, it is known that an amount of light reflected by the original is sensed by a photosensor, the output of which is processed and then used for controlling a developing bias or an amount of exposure on a real time basis.

Actually, however, when this idea is implemented, background foggy images result at portions corresponding to the neighborhood of edges of the original.

The cause of this as well as a solution thereto is not known.

SUMMARY OF THE INVENTION

Accordingly, it is a principal object of the present invention to investigate the cause of the above problem and to provide a copying apparatus which is substantially free from the problem.

It is another object of the present invention to provide a copying apparatus whereby a good image can be formed in accordance with an original without foggy background.

These objects are attained by providing an apparatus which scans an original and progressively forms an image of the original on a photosensitive member in accordance with a variable image forming condition. The apparatus progressively detects the density of the original, and progressively controls the image forming condition corresponding to an area of the original in a first manner using the detected density of the area of the original, except for an end area adjacent to an end of the original. The apparatus also controls the image forming condition for the end area in a second manner which is different from the first manner.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
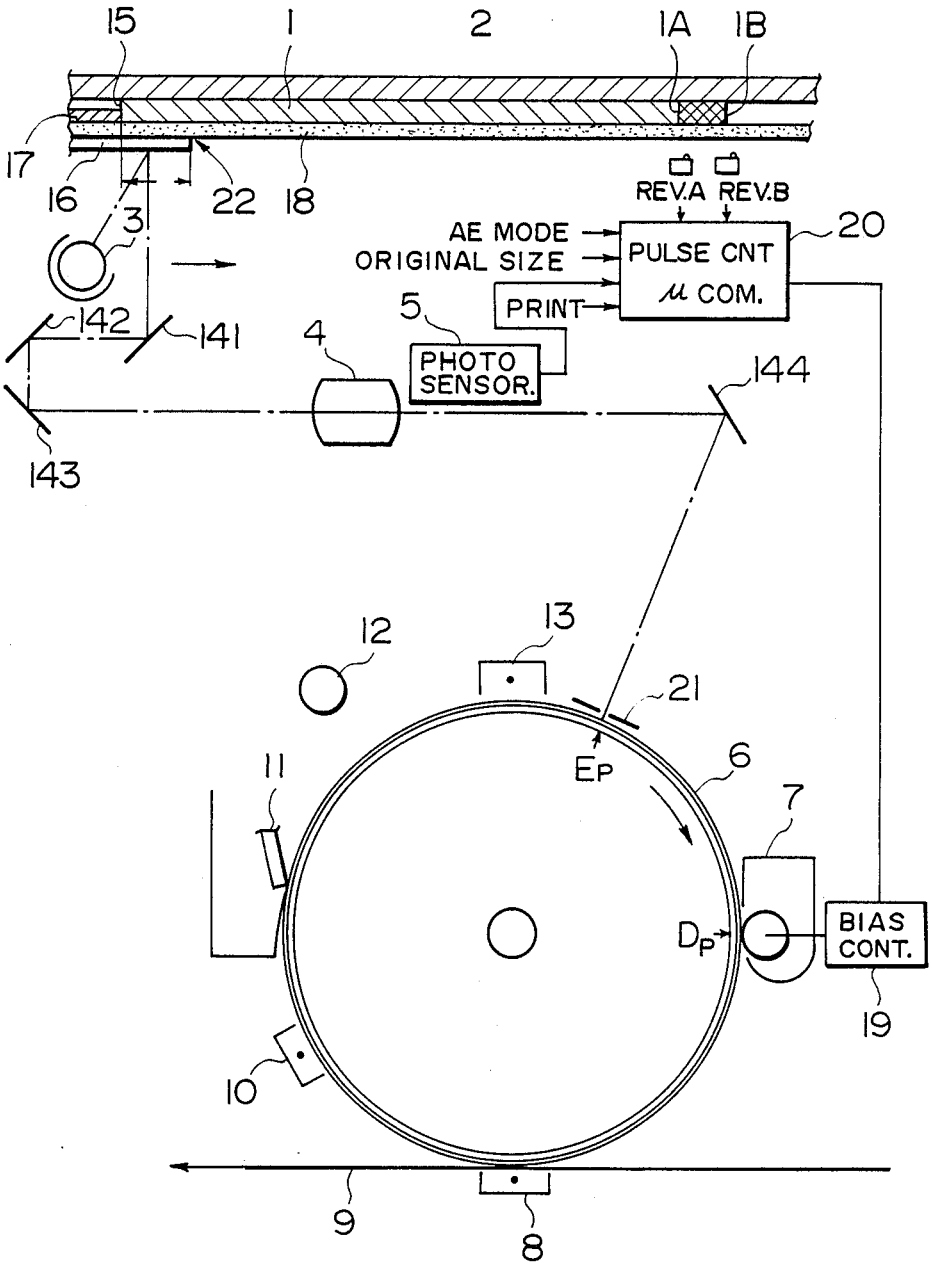
FIG. 1 is a somewhat schematic view of a copying apparatus according to an embodiment of the present invention.

Referring to FIG. 1, there is shown an electrophotographic copying apparatus according to an embodiment of the present invention.

An original 1 is illuminated by an original illuminating lamp 3. The light reflected by the original 1 is directed to a photosensitive drum 6 having a photosensitive layer through optical members including mirrors 141–144, lens 4, aperture slit 21. Prior to the exposure to the light, the photosensitive drum 6 is uniformly charged to a predetermined polarity by a charger 13. Therefore, when exposed to the light reflected by the original 1, the photosensitive drum 6 forms thereon an electrostatic latent image corresponding to the original in accordance with the amount of light reflected thereby. The latent image is visualized with developer particles (toner) by developing means 7. The visualized image is transferred onto a recording sheet 9 by a transfer charger 8, and thereafter, the transferred image is fixed on the sheet 9 by fixing means not shown. The peripheral speed of the photosensitive drum 6 in the direction shown by an arrow is the same as the speed of the sheet 9, which is fed to the photosensitive drum 6 so that it is registered with the toner image on the photosensitive drum. After the image transfer, the photosensitive drum 6 is subjected to a pre-discharger 10, cleaning means 11 and pre-exposure lamp 12, so that the photosensitive drum 6 is prepared for the next image forming operation.

The apparatus is operable in an automatic exposure mode wherein the apparatus is automatically responsive to the density of the original to be copied. When this mode is selected, the density of the original is detected by a photosensor 5, such as a semiconductor image sensor, located behind the lens 4, the output of which is transmitted to central control means 20 in the form of a microcomputer, which controls developing bias control means 19 for controlling a developing condition, so that the formation of the toner image is performed in response to the detected original density. Such a control is carried out for each of segments of the length of the original.

Figure 2:
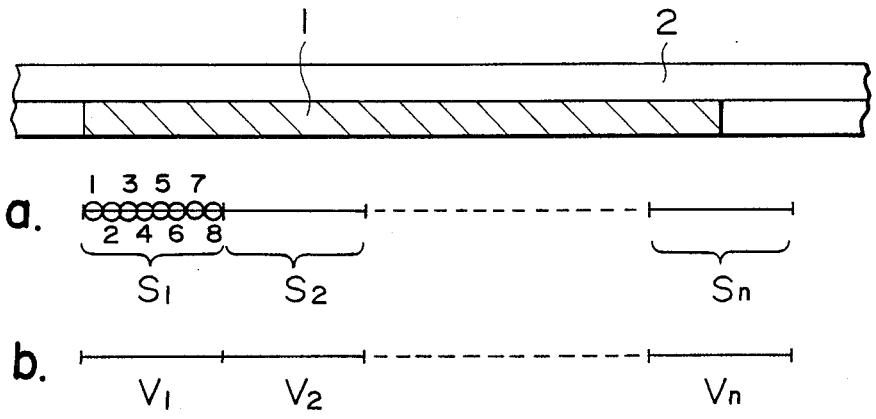
FIGS. 2 and 3 illustrates the causes of the problem which is solved by the present invention, FIG. 3 being an enlarged view adjacent the trailing edge of an original.
Figure 3:
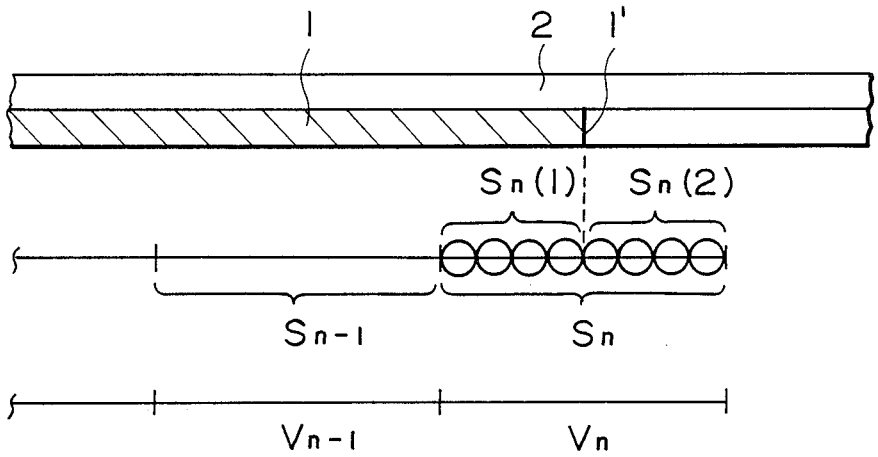

For the purpose of understanding the present invention, the problem will be described, which will exist adjacent a longitudinal end of the original, that is, the end of the direction of scan for the original, in conjunction with FIGS. 2 and 3.

The segment length is constant irrespective of the size of the original to be copied. It may correspond to a time length of a half wave of the power source frequency and for example, when the frequency of the power source is 50 Hz, the segment length corresponds to 8 sampling points (8 mm when the process speed is 100 mm/sec). The average SX (X: 1-n) of the original image densities, for each of the segments, is used for determining the developing bias voltage VX (X: 1-n), after corrected in accordance with other image forming conditions (for example, magnification). A problem arises, as shown in FIG. 3 which is an enlarged view in the neighborhood of the trailing edge of the original, where the last segment covers the trailing end portion 1' of the original and a white surface of an original pressing plate 2. For example, if 4 sampling points are to the original 1, and the remaining 4 sampling points are to the plate 2, then the detected density Sn does not represent the density of the original when the original has a relatively dark background, as in a newspaper, and when the original pressing plate 2 is white. More particularly, the detected density Sn and the corresponding developing bias Vn are, $$Sn_{(1)}' < Sn < Sn_{(2)}' \quad (1)$$

$$Vn_{(1)}' > Vn > Vn_{(2)}' \quad (2)$$

where $Sn_{(1)}'$ is the density detected by 8 sampling points which are all in the original; $Sn_{(2)}'$ is the density detected by 8 sampling points which are all in the white area of the original pressing plate 2; $Vn_{(1)}'$ is the developing bias corresponding to $Sn_{(1)}'$; and $Vn_{(2)}'$ is the developing bias corresponding to $Sn_{(2)}'$.

It will be understood that the proper developing bias is $Vn_{(1)}'$, but actually, the developing means is operated with the bias of Vn unavoidably due to the sampling system. This has been found to be a cause of unclear and foggy images adjacent to the trailing edge of an original.

Figure 4:
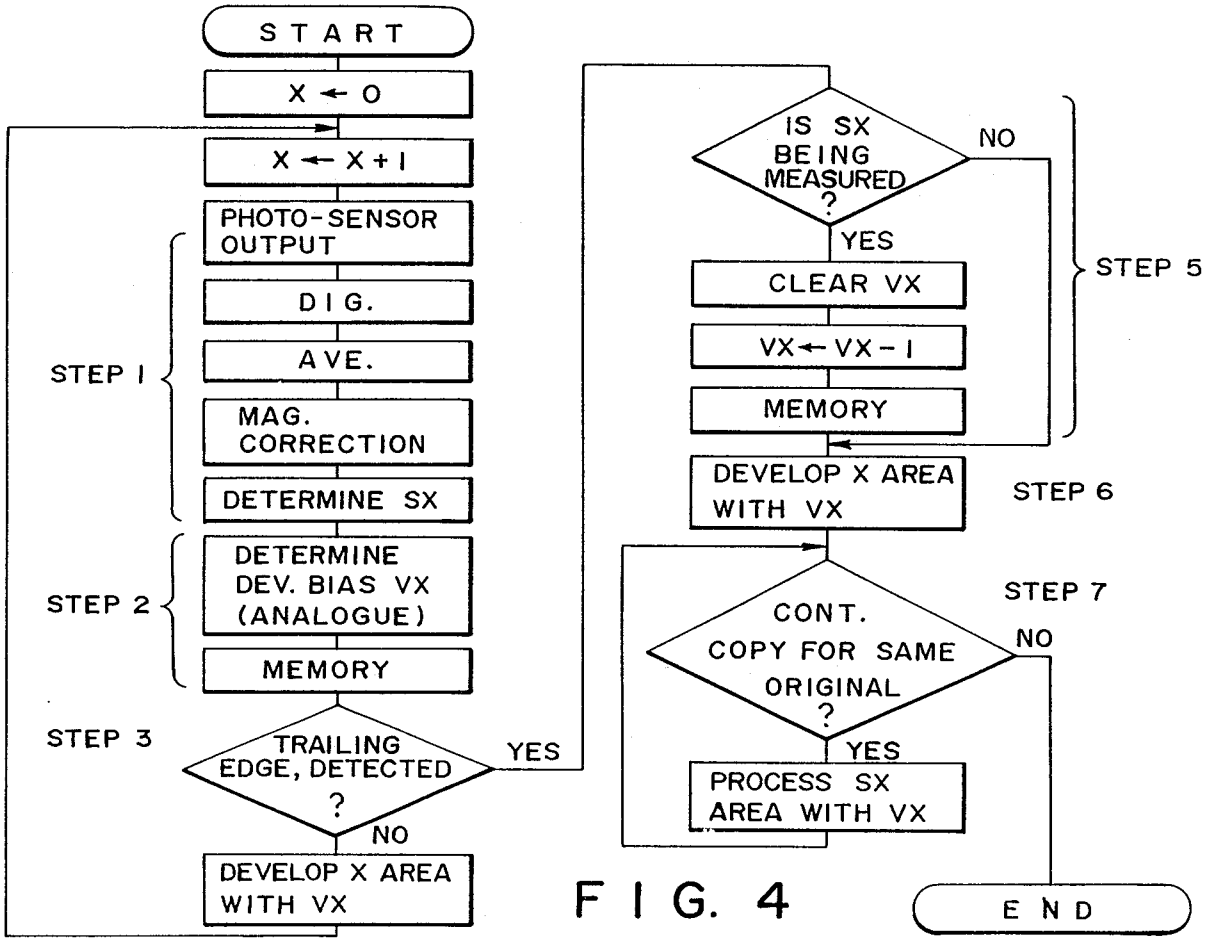
FIG. 4 is a flow chart of a control to be effected with FIG. 1 embodiment.

FIG. 4 is a flow chart of a control system used with the present invention, which solves the above problem. In this control, a real time system is employed, in which the control is effected concurrently with illuminating the original, utilizing the time period required from the original being illuminated to the corresponding latent image reaching the developing station Dp by way of the exposure station Ep. Upon receiving a printing signal, the microcomputer 20 rotates the photosensitive drum 6, which produces pulse signals at regular intervals. In response to the pulse signals, the microcomputer 20 controls operations of various parts.

The leading edge 15 of the original 1 is positioned to an index plate 17 on an original supporting glass 18. The lower surface of the original 1 adjacent to the leading edge 15 thereof is, in effect, covered by a white plate 16 which is contacted to the bottom surface of the supporting glass 18 so as to render the leading area white. By doing so, no image is formed on the leading area of a recording sheet 9 so that the sheet 9 is easily separated from a photosensitive drum 6 and from an image fixing roller.

Figure 5A:
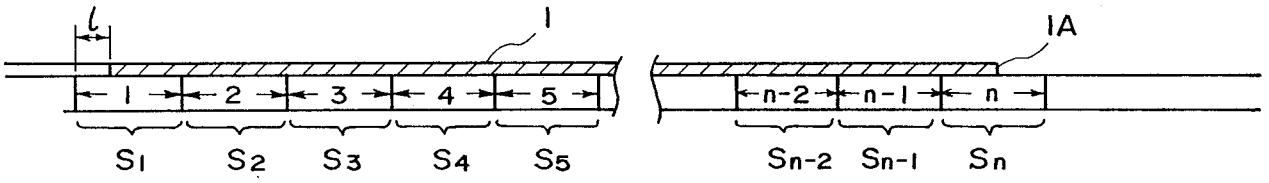
FIGS. 5A and 5B are timing charts of the control.
Figure 5B:
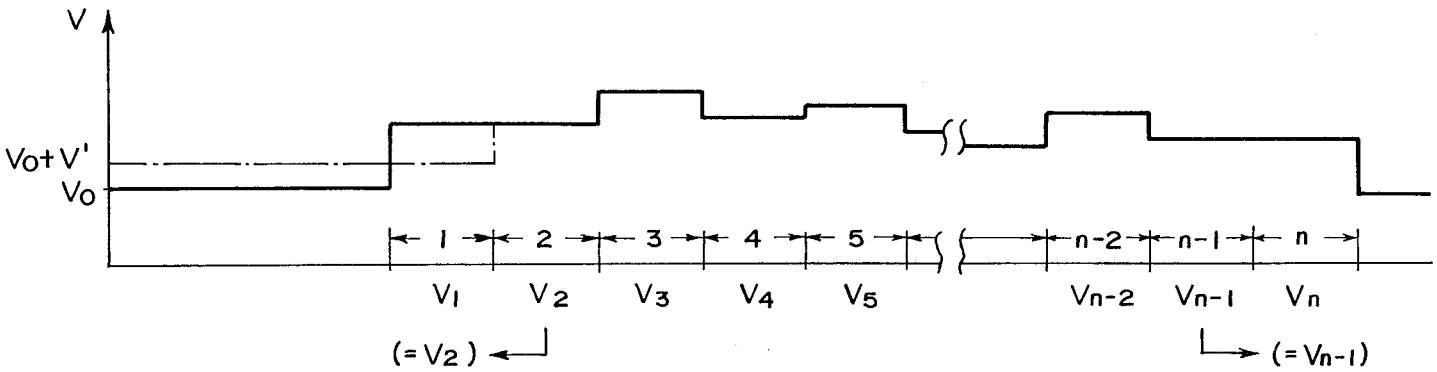

When the lamp 3 moves at a constant speed from the leading edge 15 of the original in the image exposure area to the trailing edge 1A thereof, the light reflected by the original is introduced to the photosensor 5. As shown in FIG. 4, upon input of "0" and "X+1" to X, the output of the photosensor 5 is taken at regular intervals as shown in FIGS. 2 and 4 into the microcomputer, which digitalizes, averages and correct on the basis of the magnification, the data to provide the image density SX as a numerical data (step 1). Then, it determines a proper amount of the developing bias in response to the data. Thereafter, the data is converted to analog data of the developing bias Vx, whereafter the proper image forming condition for the segment X is stored (step 2). Similarly, the data Sx and Vx are determined sequentially until the trailing edge 1A of the original 1 is detected at step 3. Thus, the image formation for the segment X is performed with the developing bias Vx so that an optimum image is formed sequentially. As shown in FIGS. 5A and 5B, when the trailing edge 1A of the original 1 is detected (X=n), and a reversing signal A is produced, the data Sn and Vn are to be determined under the condition including the condition around the trailing edge. To avoid this, at step 5, the data Sn and Vn for the segment n of the original 1 is cleared (or not detected, or not processed), instead the preceding data for the segment n-1 is stored as the data for the sake of the segment n. Thus, for the segment n, the bias Vn-1 (the bias for the segment n-1) is used as the bias Vn for the segment n (step 6).

When additional copies are to be produced from the same original, the image formation is controlled in accordance with the developing bias values stored for the respective segments. Upon completion of the repeated copying operation, the sequence of the flow ends.

A new original is to be copied, the sequence of this flow is carried out, again.

For the purpose of detecting the trailing edge of the original, microswiches may be provided at the respective ends of originals for different sizes of originals. Or, it may be detected on the basis of the number of the above-mentioned pulses. For example, the microcomputer 20 stores the data of 129 pulses for the size B5 (JIS), 148 pulses for A4 and 182 pulses for B4. If the apparatus is of such a type that it can meet random sizes of the original and that the trailing edge of the original can be manually set, the set position may be stored as the original trailing edge data.

In FIG. 1, the reference "1B" indicates a trailing edge when the size of original is large. In this case, the reversing signal B is used at step 3.

As shown in FIG. 4, at step 5, a discrimination is made as to when the trailing edge is detected. When the discrimination shows that the trailing edge is incidentally a boundary of the segment, the control is effected on the basis of the data Sn and Vn, because in such a case, the data Sn and Vn is not very far from the correct data. This additional control may be effected, if necessary.

As for the specific image condition for the trailing segment, the description has been made with respect to the image forming condition of the adjacent segment. But, this is not limiting, and it may be an average of the data for a part or the entirety of the original except the end segment, an average of the data for plural segments or the data or datum for the segments or a segment not adjacent to the end segment. In order to avoid an abrupt density change, it is preferable to employ the adjacent segment data.

In the foregoing, the trailing edge of the original has been dealt with, however, the similar problem arises adjacent the leading edge of the original, when the original is not placed in a correct position so that the white or the stained portion of the original pressing plate 2 is taken as a part of the original adjacent the leading edge portion, when the light reflected by the white plate 16 under the glass support 18 and the light reflected by the original 1 are taken as input, or when the shade created by a white plate 16 is read adjacent to the portion 22 in the end area.

An improper image formation will result if it is carried out on the basis of the information taken from the first segment.

According to another embodiment of the present invention, the developing bias as the image forming condition for the first segment which is adjacent to the leading edge of the original 1 is made equal to the developing bias V2 for the second segment, or a predetermined fixed bias may be used for the first segment. The predetermined bias may be a sum of a developing bias V0 with which the white plate 16 is developed as white and as bias correction V′ for correcting the bias in view of the decrease of the reflected light through the glass support 18. An example of the correction value is 10–50 V for 5–15% decrease of the amount of light.

The length l of the white plate 16 corresponding to the leading edge portions of the original is generally 2–5 mm, and is 4 mm in this embodiment. Since the white plate 16 is fixed adjacent to the position of the leading edge 15, and therefore, the length is also fixed. This length in the first segment may be stored as the white plate, whereby during the sampling period for the length l of the white plate 16 from the start of the original exposure operation, the developing bias may be V0; and during the rest of the sampling period for the first segment, the developing bias may be V0+V′. Further, during the latter sampling period, the image forming condition may be equal to that for the second segment, that is, V2.

For this embodiment, a flow chart is not shown, but it will be readily understood that the flow chart of FIG. 5 may be modified so that the bias V2 is stored, and the operation on the basis of the bias V2 is effected to both of the segments 1 and 2. For the first segment, the predetermined bias value V0 or V0+V′ is used for a period of a predetermined number of pulses from the leading edge image reaching the developing station Dp. As for the specific image condition for the trailing segment, the description has been made with respect to the image forming condition of the adjacent segment. But, this is not limiting, and it may be an average of the data for a part or the entirety of the original except the end segment, an average of the data for plural segments or the data or datum for the segments or a segment not adjacent to the end segment. In order to avoid an abrupt density change, it is preferable to employ the adjacent segment data.

As described, according to the present invention the image forming condition for the trailing edge portion and/or the leading edge portion of the original is/are not determined on the basis of the data obtained from the corresponding portions, but determined independently thereof. This is advantageous in making it possible to form an image without the fog adjacent the edge portions, irrespective of the kinds of originals to be copied (particularly, the darkness of the background of original).

In the foregoing embodiments, the length W of the segment is fixed as being 8 mm (process speed of 100 mm/sec, 50 Hz of zero cross signal, and 8 point sampling). However, another fixed length may be employed.

In another aspect of the present invention, the original density is detected by the photosensor, and the resultant instruction value may be fed back to the original illumination lamp to control the light quantity of the lamp. Alternatively, a surface potential of the latent image on the photosensitive drum may be sensed by a surface potential sensor, and then it is used to control the developing bias. Those are included in the scope of the present invention. By the structures described above, a clean and sharp image without the fog at the end portions can be provided even when an original is to be copied which has a relatively dark background, as in a newspaper, which is different in darkness from the original pressing plate (white), or when the sampling area of the reflected light bridges between the original edge and the pressing plate or a white plate.

The foregoing description has been made with respect to a copying apparatus wherein the optical system is movable for scanning the original, but the present invention is applicable to such a type wherein an original carriage is movable in place of the optical system or to a copying apparatus of the type wherein the original is scanned while it is transported through an exposure station.

According to the embodiments of the present invention, an optimum image reproduction can be made in accordance with the density of the original. Further, since the control is made to the portions of one original, it can meet the density variation within one original. Therefore, the copy sheet will not be wasted because of improper exposure, so that the copy taking operation is carried out efficiently.

According to the embodiment of the present invention, the image forming condition for the edge portion or portions is set to be the image forming condition similar to that for the other part, the image forming condition can be surely set with high precision for a half tone chart or the like, so that a stabilized image formation can be achieved.

Figure 6:
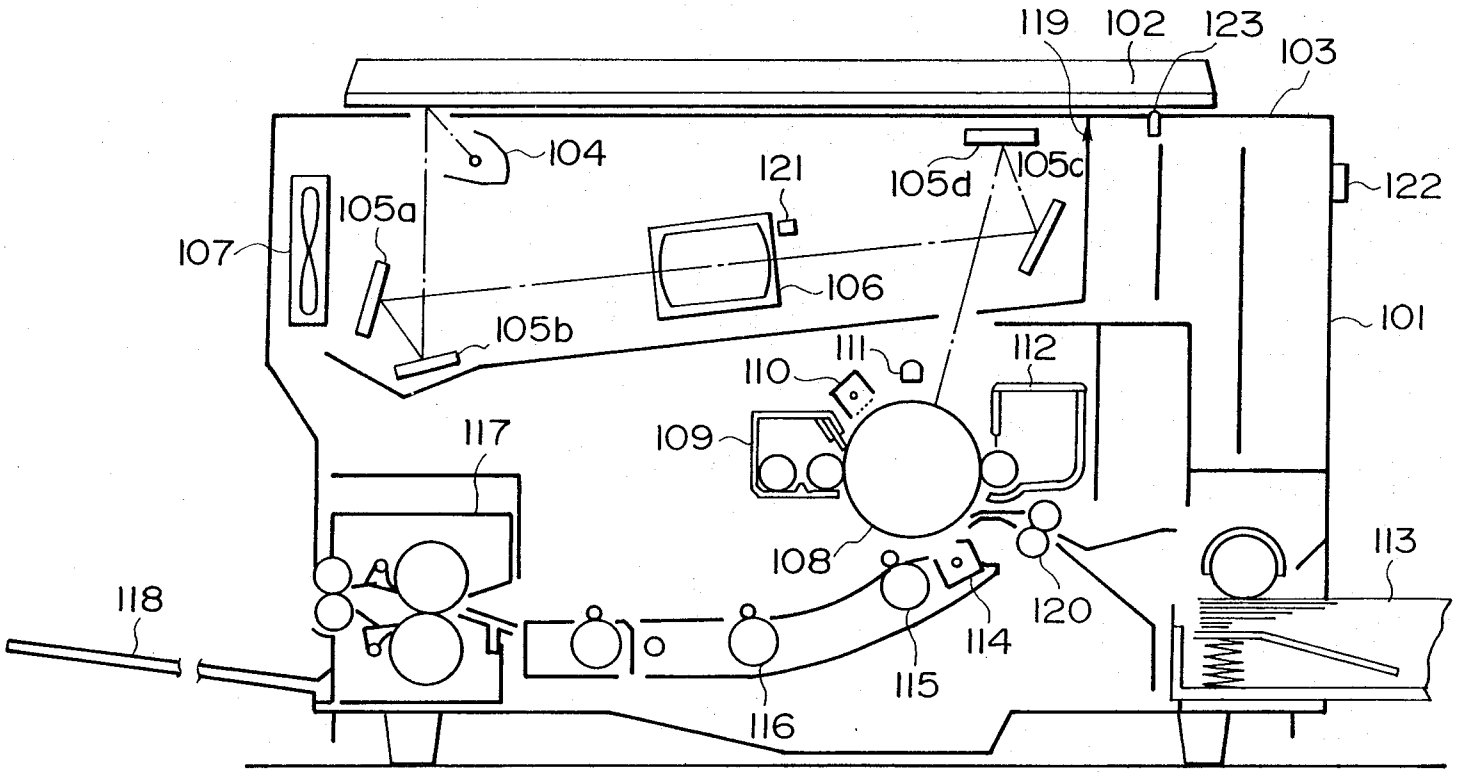
FIG. 6 is a cross-sectional view of a copying apparatus according to the embodiment of the present invention.

FIG. 6 is a cross-sectional view of a copying apparatus according to an embodiment of the present invention. The apparatus includes a main frame 101, an original cover 102, an original support and operation panel 103, an original illuminating lamp 104, reflecting mirrors 105*a*–105*d*, a zoom lens 106 for varying the magnification 106, a fan 107 for discharging heat, a photosensitive drum 108, cleaning means 109 for removing residual toner from the photosensitive drum 108, a charger 110 for uniformly charging the photosensitive drum 108 to a positive or negative polarity, a blank exposure lamp 111 for removing the electric charge from a non-image-forming area on the photosensitive drum 108, developing means 112 for developing an electrostatic latent image formed on the photosensitive drum 108, a paper feed cassette 113 for containing transfer sheets, a transfer charger 114 for transfering the toner image formed on the photosensitive drum 108 by the developing means 112 onto the transfer sheet. The apparatus further includes a transportation rollers 115, and 116, image fixing means for fixing the toner image on the transfer sheet, a copy tray 118, a sensor 119 for detecting the leading edge of the original, a registration roller 120, a photosensor 121 for detecting the light reflected by the original to determine the density of the original, a power switch 122 and a home position sensor 123. The operation of this copying apparatus is substantially similar to that of FIG. 1, and therefore, the detailed description thereof will be omitted for the sake of simplicity.

Figure 7:
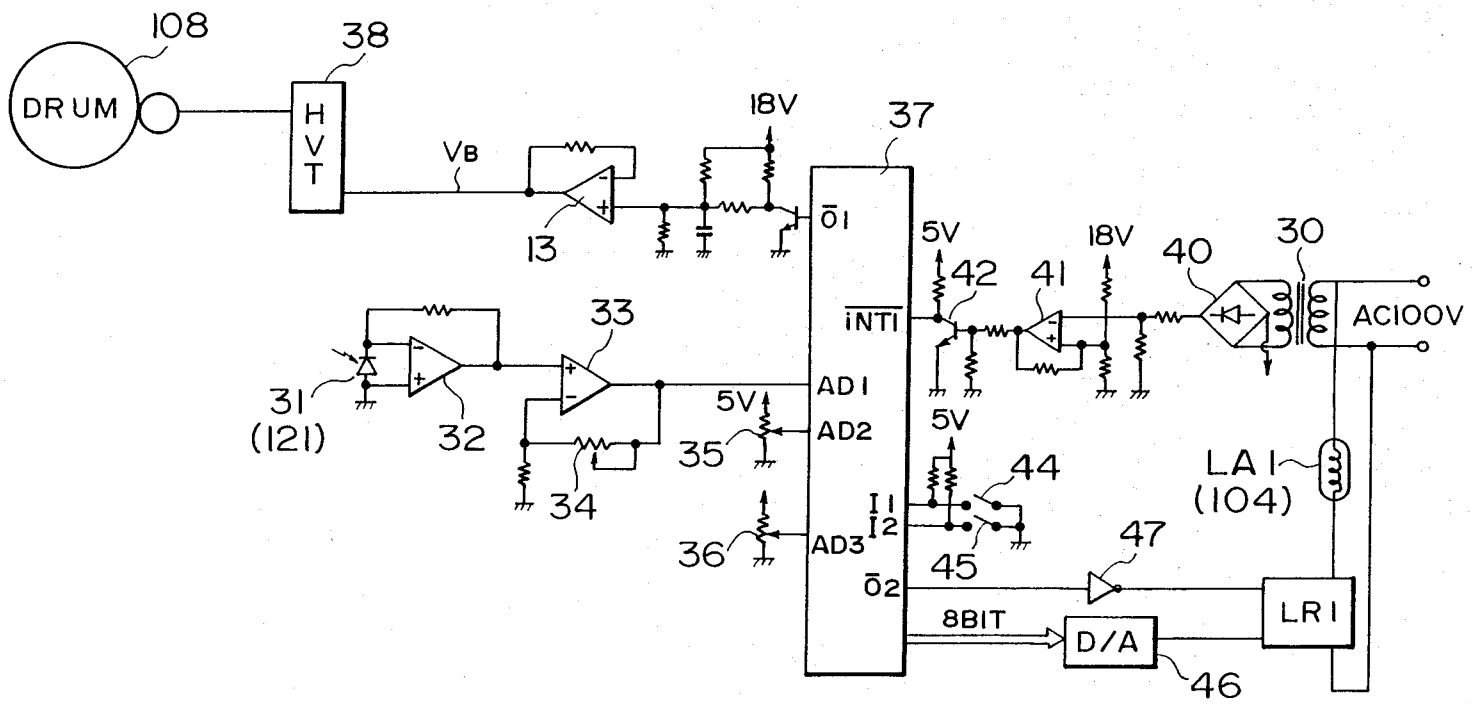
FIG. 7 shows an electric circuit for detecting density of an original used with the apparatus according to the embodiment of the present invention.
Figure 8:
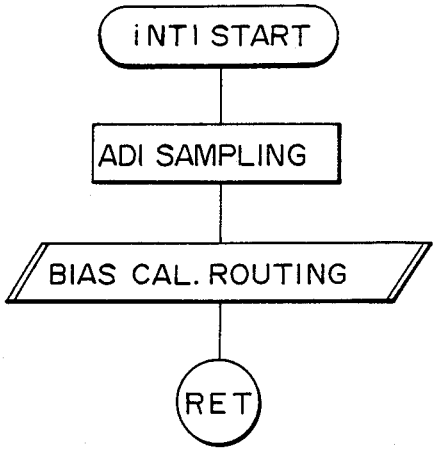
FIG. 8 is a flow chart of an interruption routine.
Figure 9:
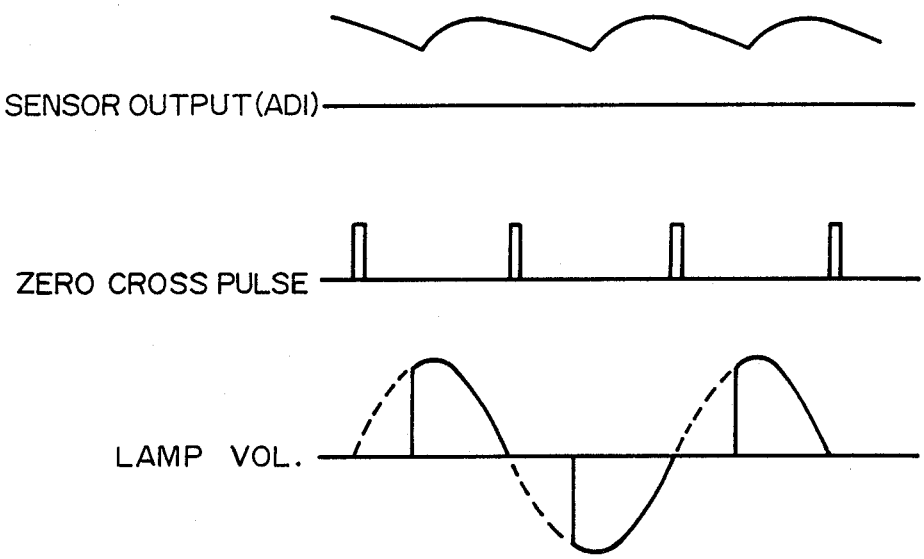
FIG. 9 shows waveforms of various parts of the apparatus.

FIG. 7 shows a circuit for detecting the density of the original. A photodiode 31 included in the photosensor 121 produces an electric current in response to the light received thereby, which current is converted to a voltage by an operation amplifier 32. And, the gain of the voltage to the microcomputer 37 is adjusted by an operational amplifier 33. The microcomputer 37 is a one-chip microcomputer having a built-in AD converter. The microcomputer 37 has an output port O1 at which a developing bias DC voltage or value for the developing means 112 is produced as a result of its processing on the basis of the input level at AD1 and the input to the volumes 35 and 36. From the output port O1, the pulses having modulated pulse width (PWM) is outputted, which is subjected to a level conversion through an integrator, and then tranmmitted to a transformer 38 as a developing bias control signal input. The volume 35 is provided to determine the developing bias DC voltage for a predetermined standard density of an original to compensate the variation in the sensitivity of the photosensitive drum 108, which is in this embodiment is an organic photoconductive drum. The volume 36 is provided to determine the changing range of the developing bias DC between the above-mentioned bias and another bias which corresponds to another standard density which is different from the above-mentioned standard density. A transformer 30 has its primary connected to an AC source, and has its secondary connected to a rectifier 40 which full-wave-rectifies the secondary side, and an operational amplifier 41 detects the zero cross. The zero cross pulse is transmitted to an interruption input $\overline{\text{INTI}}$, then an interruption processing is effected as shown in FIG. 8, sampling AD1. The waveform of the signal AD1 is, as shown in FIG. 9, synchronized with the "ON" voltage waveform of the original illuminating lamp 104 in the form of a halogen lamp LA1, that is, it changes with the period of a half of the power source period. Therefore, it is desirable that the sampling is effected at the zero cross point in order to obtain correct data. Switches 44 and 45 are effective to select the quantity of light emitted by the halogen lamp (4 level selection), and transmits "ON" voltage control signal to a lamp regulator LR1 through a D/A converter. From an output port O2, a lamp "ON" signal is produced.

Figure 10:
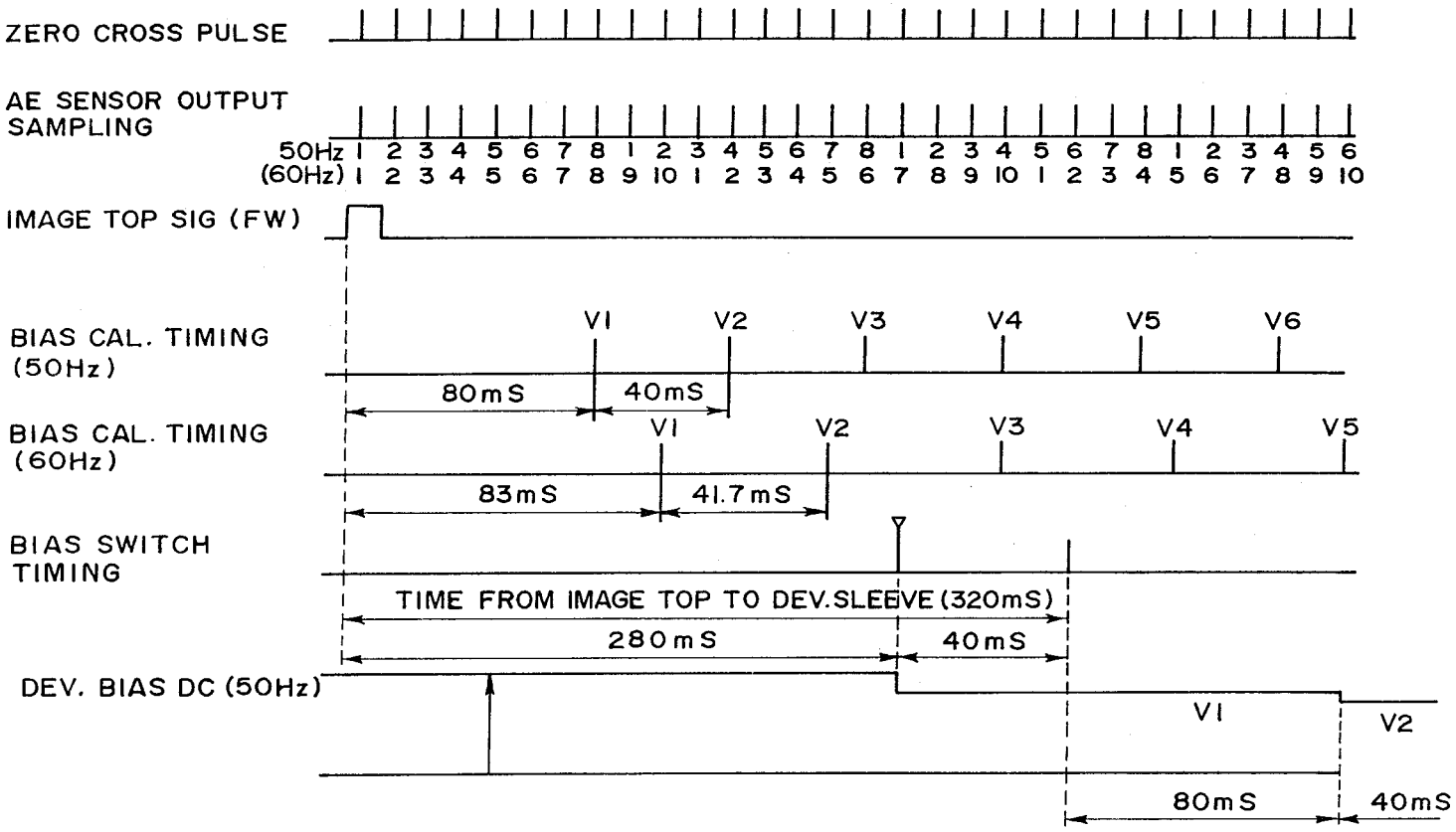
FIG. 10 shows timing charts.

FIG. 10 contains timing chart of the operation of the automatic proper density control function (hereinafter called "AE function") according to the present invention. The copying apparatus in this embodiment is provided with the zoom lens 104 which can reduce or magnify continuously, more particularly, at a step of 1% magnification.

Figure 13:
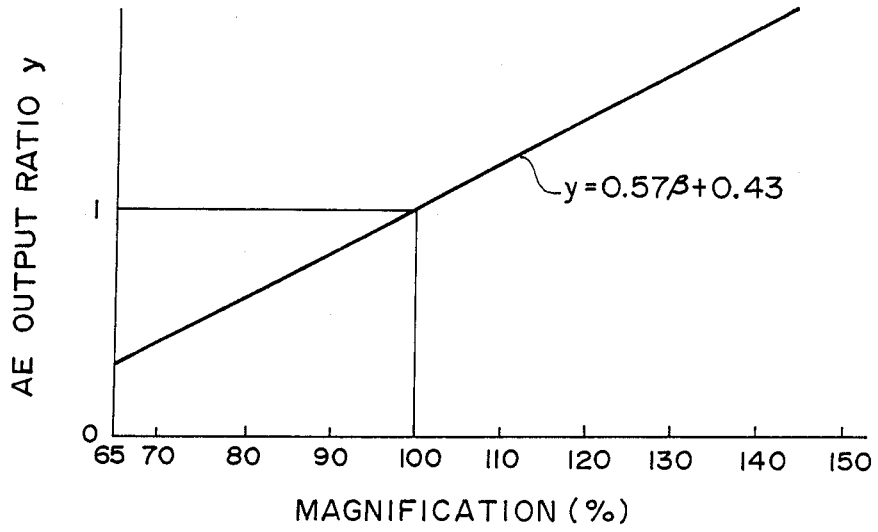
FIG. 13 illustrates the relation between a copy magnification and an automatic exposure sensor output.

FIG. 13 shows the relation between the sensor output (AD1) and the magnification when the same original is placed. As will be understood, the relation is linear. Therefore, the output (AD1) of the sensor as a result of the sampling, is corrected in accordance with the copying magnification on the basis of the linear relation shown in FIG. 13 to the value as if the magnification is 1, which will be described hereinafter.

Figure 11:
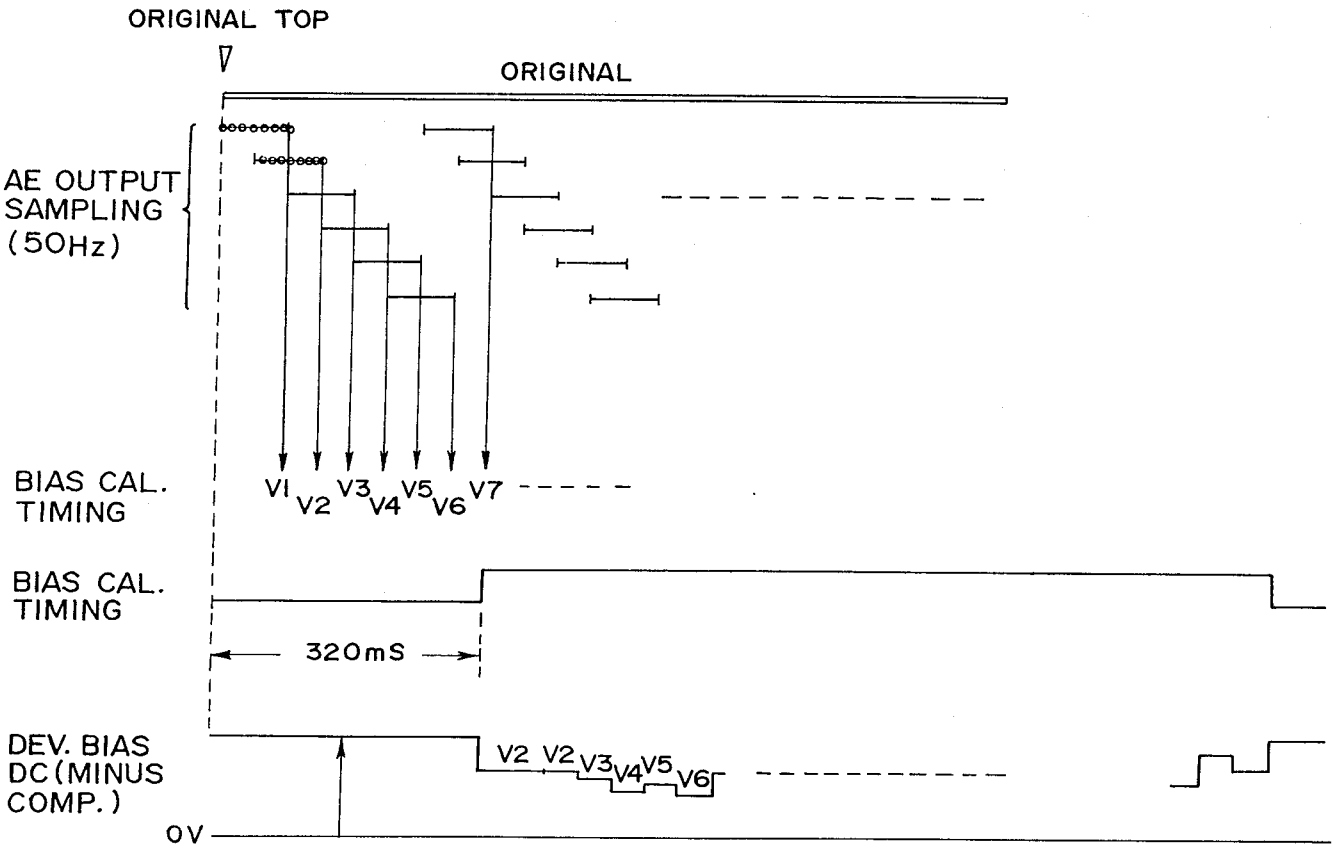
FIGS. 11 and 12 show the correspondence between sampling areas of an automatic exposure sensor output and a developing various output DC voltage.
Figure 12:
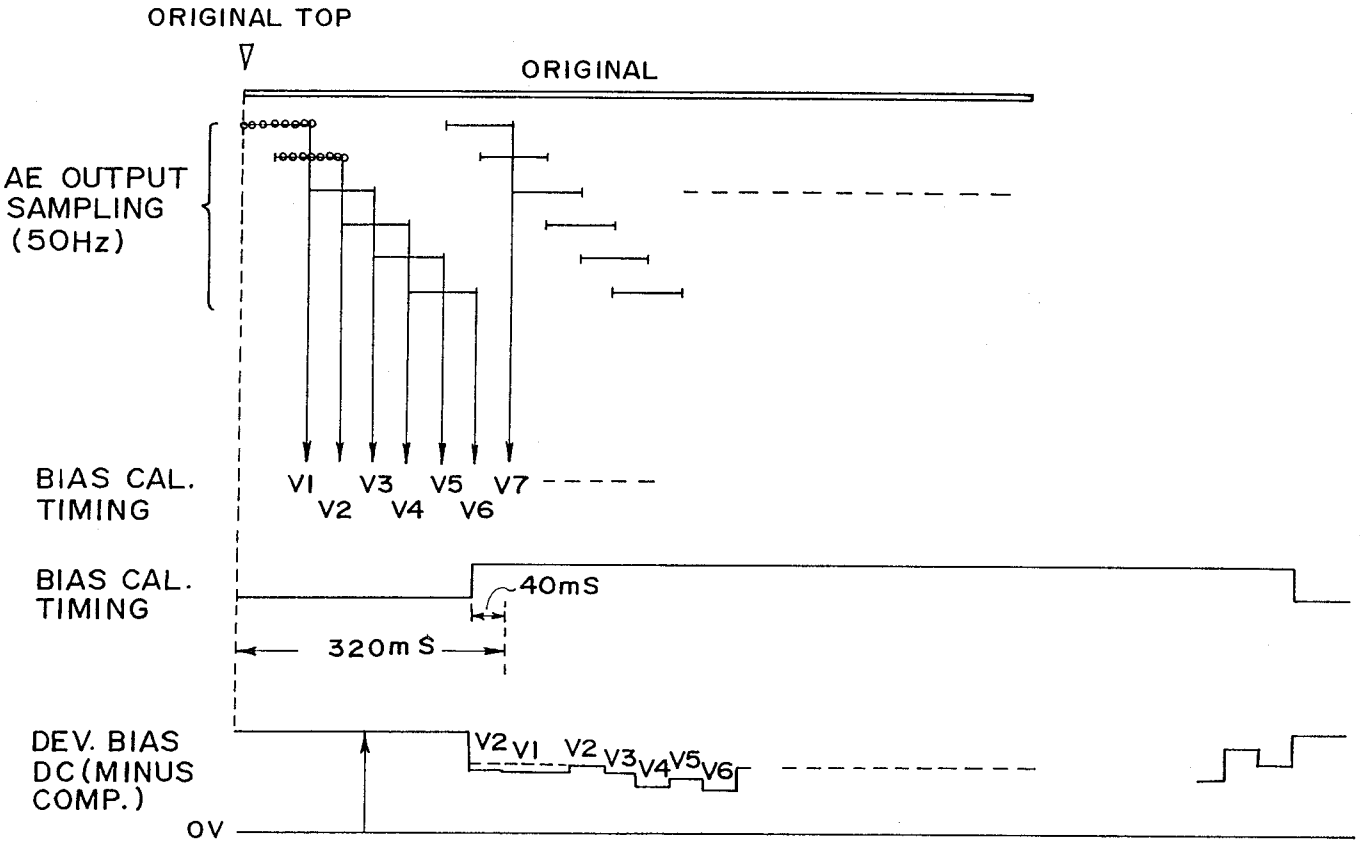

With reference back to FIG. 10, the AE function of this embodiment is performed on a real time bases wherein the light reflected by the original is received by a photosensor 31 while the original is being scanned; the output of the photosensor 31 is taken at zero cross points; and the thus taken data are processed to figure out a proper developing bias with which the developing means is operated. First, an original leading edge signal is produced by the leading edge sensor 119 during advancement of the original carriage. Then, following the photosensor output at the zero cross point, 8 point sampling, when the power source frequency is 50 Hz, is performed to determine the first developing bais V1. When the frequency is 60 Hz, 10 point sampling is employed. At a certain point during the first sampling area, the next sampling starts in parallel. As shown in FIGS. 11 and 12, in the case of 50 Hz, at the fifth point of the first sampling, the next sampling starts; in the case of 60 Hz the next sampling starts at the sixth point of the first sampling. In the next sampling, the next bias DC is determined on the basis of the 8 point or 10 point data of the second sampling. Thereafter, the same operation is repeated to provide the developing bias V3, V4 . . . .

The developing bias DC values V1-Vn are sequentially outputted at the timing shown in FIGS. 10–12. The first and the last bias values are determined in the manner described in the previous embodiments. FIG. 11 contains an idea similar to that contained in FIG. 5. The bias change starts at the time when 320 msec passes from generation of the leading edge signal, the time period 320 msec is obtained by dividing the distance, 32 mm, from the image exposure station A on the photosensitive drum to the developing station by the process speed 100 mm/sec.

In this embodiment, the first datum V1 is not used, because it contains the leading end blank of the original, which is approximately 2 mm. Instead, as shown in FIGS. 7 and 8, the second datum V2 next to the first data V1 is used for the developing bias to be used with the first developing bias. Because of this, even when the leading portion of the original is a half tone chart or the like, an image can be formed in good order without a background fog.

As will be understood from the foregoing description, in the real time AE control in this embodiment, the area of the latent image is developed with the bias voltage Vn which is determined on the basis of the original density of the corresponding area and the original density of the adjacent preceding area of the original. Because of this, there occurs no abrupt density change on the copy at the boundary of the bias change from Vn to Vn+1, despite the AE function controls the developing bias for each of a unit time period (40 msec for 50 Hz and 41.5 msec for 60 Hz).

In FIG. 12, the bias control starts prior to the time when 320 msec passes which is obtained in the manner described with respect to FIG. 11, more particularly 40 msec prior to that, i.e. 280 msec after the leading edge signal. This is determined in view of some input errors and transient state of the developing bias change.

As will be understood for the foregoing description, in the real time AE control in this embodiment, the area of the latent image is developed with the bias voltage Vn which is determined on the basis of the original density of the corresponding area and the original density of the adjacent preceding area of the original. Because of this, there occurs no abrupt density change on the copy at the boundary of the bias change from Vn to Vn+1, despite the AE function controlling the developing bias for each of a unit time period (40 msec for 50 Hz and 41.5 msec for 60 Hz).

According to the arrangement of FIG. 12, the image forming condition for the leading edge portions of the original is determined prior to the leading edge thereof is reached by the scanning, the controlled condition can be precisely set with certainty independently from input errors or transition of the developing bias change, so that a stabilized image formation can be achieved.

Figure 14:
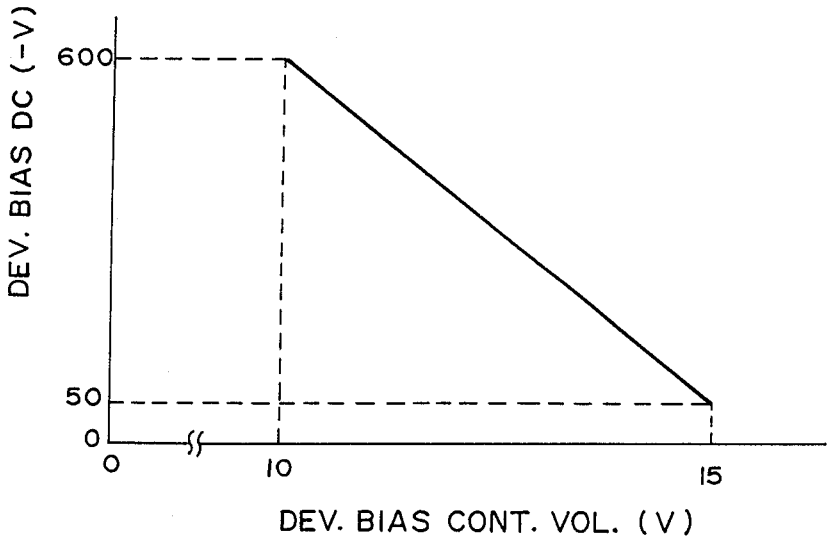
FIG. 14 shows a performance of a high voltage transformer for the developing bias.
Figure 15:
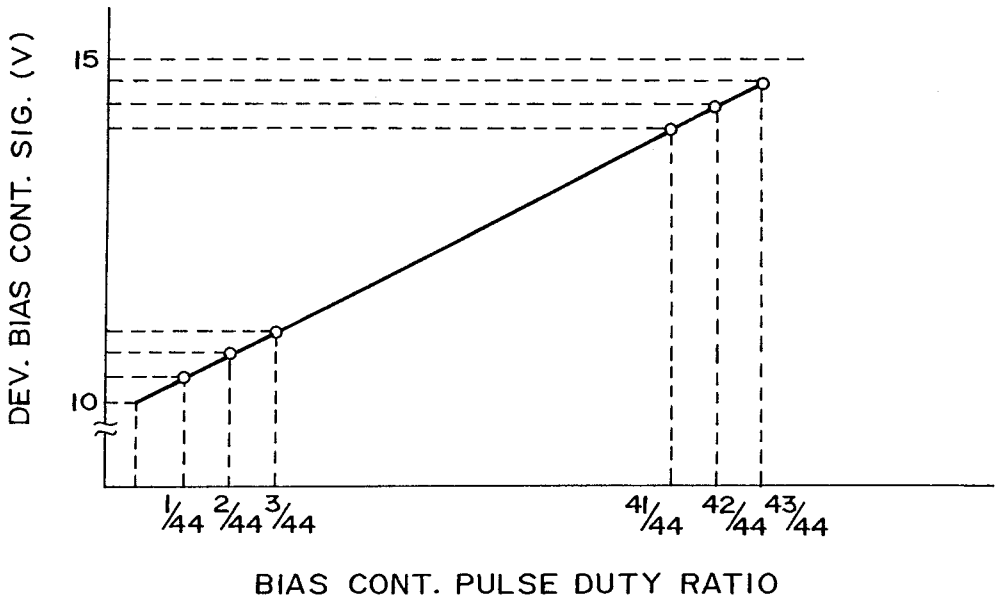
FIG. 15 illustrates the relation between the developing bias control pulse and the developing bias control signal.

In the foregoing, the control timing of the real time AE function has been described. Next, the calculation to obtain the developing bias will be described. The calculation is executed in the zero cross interruption routine. The high voltage transformer 38 used with this embodiment provides the bias voltage from −50 to −600 V linearly in response to 10–15 V of the control signal, as shown in FIG. 14. To obtain the control signal, as shown in FIG. 7, PWM (pulse width modulated) pulse is produced from the output port O1 and is introduced into an integrator to be converted to a control signal. This is shown in FIG. 15. In this embodiment, the 43 divided duty ratio of a pulse is prepared for the purpoes of controlling the developing bias DC value control signal. Therefore, the resolution of the developing bias DC value is, $$(600\text{-}50)/44 = 12.5 \text{ V}$$

A pulse having the duty ratio corresponding to the developing bias value calculated by the bias processing routine shown in FIG. 8, is sequentially produced at the output port O1 so as to effect the proper copy density control.

Figure 16:
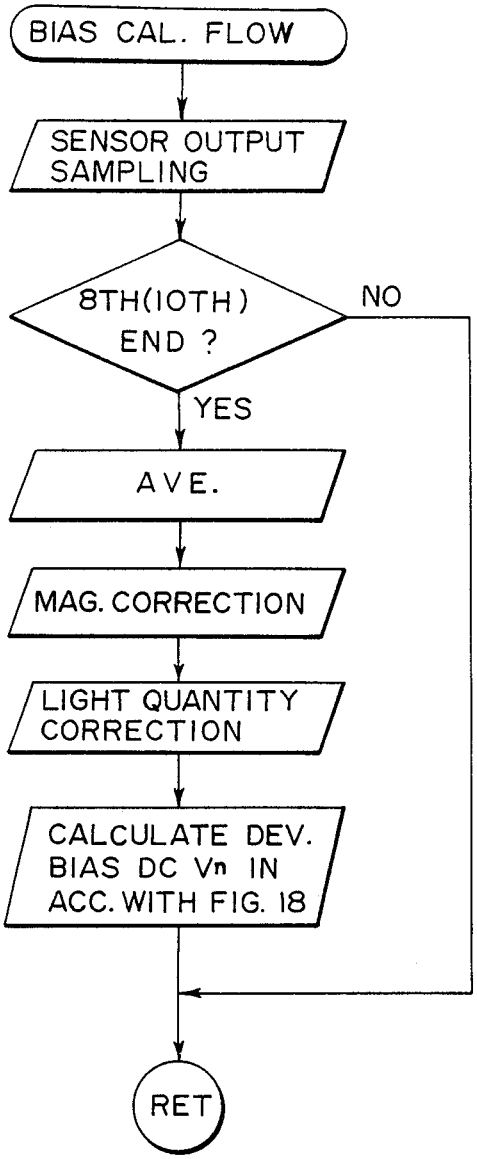
FIG. 16 is a flow chart of calculating the bias voltage in an automatic exposure control.
Figure 17:
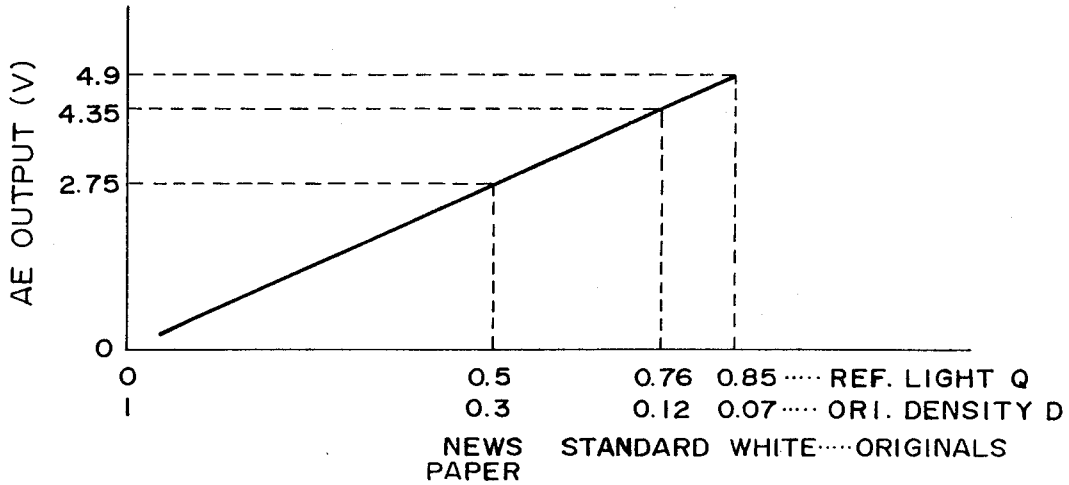
FIG. 17 illustrates the relation between an amount Q of the original reflecting light and an automatic exposure sensor output.
Figure 18:
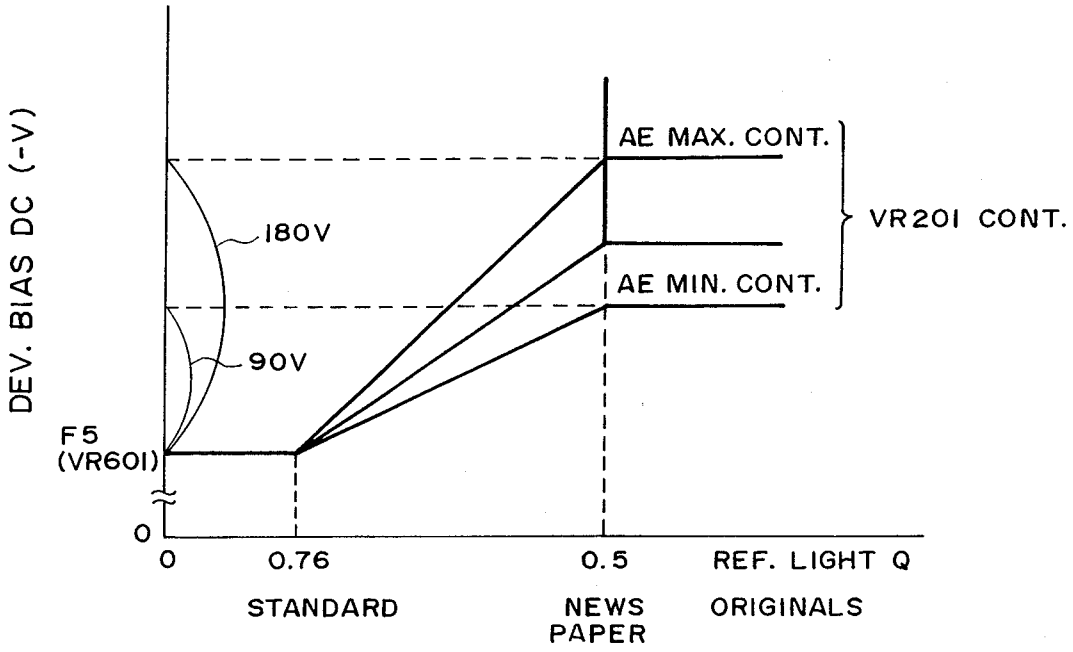
FIG. 18 illustrates the amount Q of the original reflecting light and the developing bias DC voltage.
Figure 19:
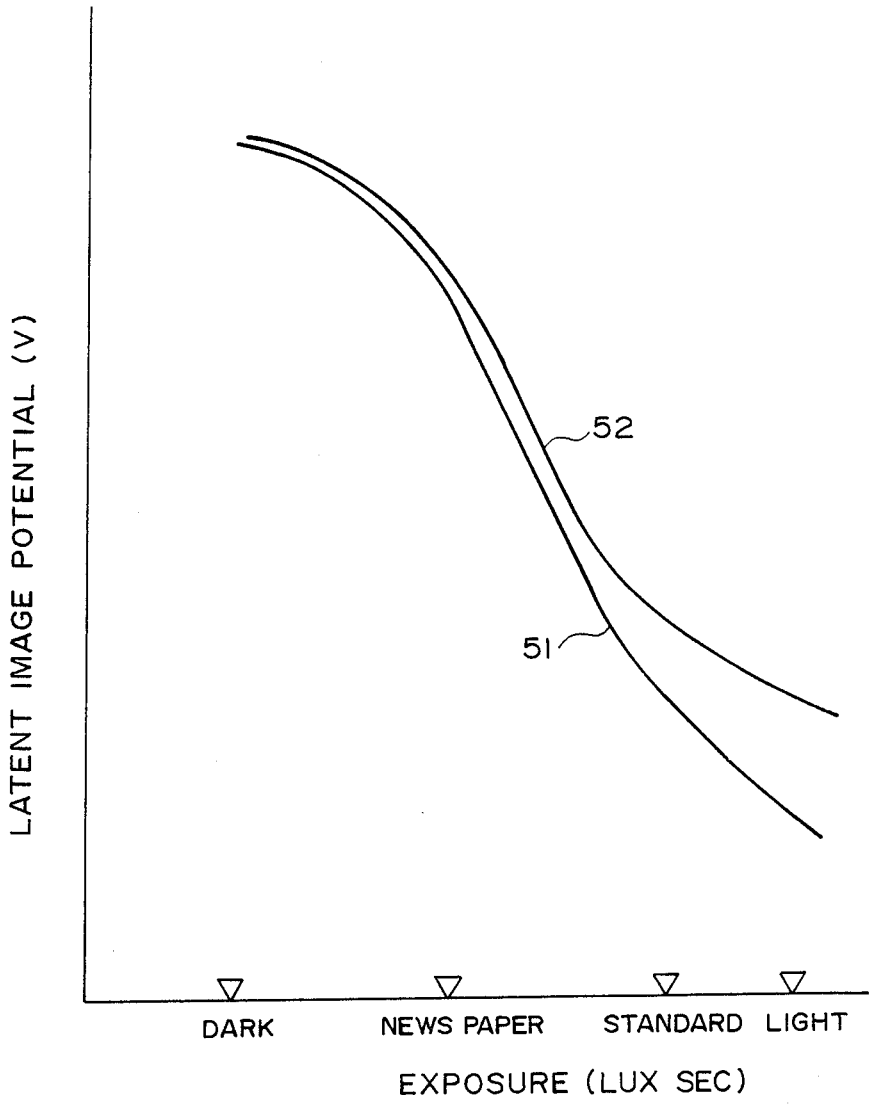
FIG. 19 illustrates the change in the sensitivity of a photosensitive drum with time.

The bias calculation routine of FIG. 8 will be explained in more detail in conjunction with FIG. 16. During advancement of the original and after the leading edge sensor detects the leading edge, an average is calculated for every eight point sampling (the freqeuncy of the power source is 50 Hz) and for every ten point sampling (the frequency is 60 Hz). The obtained average values are corrected on the basis of the linear relation with the magnification, thus the values being as if the magnification is the unit one. More particularly, the corrected data Vn is obtained by the following $$\begin{aligned} Vn &= Vn/(0.58b + 0.43) \\ &= Vn/(0.57x(x/100) + 0.43) \end{aligned}$$

where $\overline{V}n$ is the average of the output when the magnification is b (x %). This is the magnification correction processing in FIG. 16. Next, light quantity correction will be described. The photosensitive drum having an organic photoconductor layer used with this embodiment shows such a property that the potential at the light area increases, and therefore, the image contrast decreases with the integrated number of copies, as shown in FIG. 19. In order to make up for this, the light quantity of the original illuminating lamp in the form of a halogen lamp is controlled by the switches 44 and 45. With the increase of the integrated number of copies resulting in the increase of the light area potential on the photosensitive drum, the actuating voltage of the halogen lamp is increased to compensate the decrease in the image contrast. As for the choice of the actuating voltages, 4 voltages are possible by the combinations of two switches 44 and 45. On the basis of the data as to how those switches are selected, the microcomputer transmits 8 bit information to the D/A converter 46, which converts the input thereto to analog data and transmits it to the lamp regulator LR1, thus giving thereto a halogen lamp actuating voltage control signal. The bias voltage value Vn provided as a result of the magnification correction is modified by the following, $$Vn' = Vn \times (E0/Em)$$

where Vn' is the developing bias after the correction on the basis of the light quantity, E0 is a standard lamp voltage and Em is one of the other three lamp voltages E1, E2 and E3. As a result of this correction, the original density to be used is determined as shown in FIG. 17. Then, the last step of the flow shown in FIG. 16 is executed. That is, the developing bias is determined on the basis of the value Vn'. FIG. 18 shows this determination, wherein the developing bias voltage is linearly changed from for a standard density original (the reflected light amount O=0.76) to for a dark background original (Q=0.5) such as a newspaper, so that dark originals are reproduced without fog, while light originals are reproduced with clear letters. The bias voltage has an upper limit and a lower limit, respectively corresponding to the dark original, darker than the newspaper, and the light original, lighter than the standard original so as to avoid too thin image or foggy image by overcontrolling. As described hereinbefore, the photosensitive drum (organic photoconductor) used with this embodiment exhibits such a property that the latent image potential changes from the curve 51 to the curve 52 in FIG. 19 with the use thereof, that is, the increase of the total number of copies. To correct this, as shown in FIG. 18, the developing bias for the standard original (the above-described lower limit) is also changeable. This is achieved by the volume 35 shown in FIG. 7. The photosensitivity change with time shown in FIG. 19 tends to decreae the contrast between the light potential (VL) and the dark potential (VD). To obviate this, the variable range of the developing bias control between the standard density original and the newspaper density original is preferably changed in accordance with the above-described variation in the photosensitivity. In this embodiment, this is achieved by the volume 36, more particularly, the controllable range is changeable between 90–180 V.

According to this embodiment, an optimum image is reproduced in accordance with the density of the original. Further, the control is executed on a real time bases within the one original, so that it can follow the density variation within one original. Therefore, the transfer or copy sheets are not wasted due to improper exposure, so that the copying operation is carried out efficiently.

The foregoing description of this embodiment has been described with respect to a copying apparatus of such a type that the original carriage is movable for scanning an original, but it is applicable to an apparatus wherein an optical system in place of the original carriage is movable, or to the apparatus wherein the original is scanned by a fixed original exposure station while an original is transported therethrough.

While the invention has been described with reference to the structures disclosed herein, it is not confined to the details set forth and this application is intended to cover such modifications or changes as may come within the purposes of the improvements or the scope of the following claims.

What is claimed is:

1. A copying apparatus comprising:
means for scanning an original;
means for progressively forming an image of the original on a photosensitive member in accordance with a variable image forming condition;
means for progressively detecting density of the original; and
means for progressively controlling the image forming condition corresponding to an area of the original in a first manner using the density of the area of the original detected by said detecting means, except for an end area adjacent to an end of the original, and for controlling the end area in a second manner which is different from said first manner, and which does not use the detected density at said end area.

2. An apparatus according to claim 1, wherein said control means determines the image forming condition for the end area in accordance with the density of a non-end area of the original detected by said detecting means.

3. An apparatus according to claim 1, wherein the end are corresponds to an area of the original adjacent to its end which is first scanned by said scanning means.

4. An apparatus according to claim 1, wherein the end area corresponds to an area of the original adjacent to its end which is last scanned by said scanning means.

5. An apparatus according to claim 1, wherein the end area includes an area adjacent to a leading end of the original and an area adjacent to a trailing end of the original, which are spaced apart from each other.

6. An apparatus according to claim 1, wherein the image forming condition for the end area is predetermined independently of the original.

7. An apparatus according to claim 1, wherein said image forming means includes optical means for exposing said photosensitive member to light reflected by the original, charging means for electrically charging said photosensitive member to a predetermined polarity, means for developing a latent image formed on said photosensitive member and means for transferring a developed image provided by said developing means onto a recording material.

8. An apparatus according to claim 7, wherein the image forming condition is a developing condition of said developing means.

9. An apparatus according to claim 8, wherein said control means determines the developing condition for the end area in accordance with the density of a non-end area of the original detected by said detecting means.

10. A copying apparatus comprising:
means for scanning an original;
means for progressively forming an image of the original on a photosensitive member in accordance with a variable image forming condition;
means for progressively detecting densities of the original for each of divided areas of the original; and
means for progressively controlling the image forming condition corresponding to a said area of the original in a first manner using the density of the said area of the original detected by said detecting means, except for an end area adjacent to an end of the original, and for controlling the image forming condition for the end area in a second manner which is different from said first manner, and which does not use the detected density at said end area.

11. An apparatus according to claim 10, wherein the end area corresponds to an area of the original adjacent to its end which is first scanned by said scanning means.

12. An apparatus according to claim 10, wherein the end area corresponds to an area of the original adjacent to its end which is last scanned by said scanning means.

13. An apparatus according to claim 10, wherein the end area includes an area adjacent to a leading end of the original and an area adjacent to a trailing end of the original, which are spaced apart from each other.

14. An apparatus according to claim 10, wherein said image forming means includes means for electrically charging said photosensitive member, optical means for exposing said photosensitive member to image light of the original, and means for developing an electrostatic latent image formed on said photosensitive member, and wherein said image forming condition is a developing condition of said developing means.

15. An apparatus according to claim 14, wherein the image forming condition is a developing condition of said developing means.

16. An apparatus according to claim 10, wherein the image forming condition for the end area is predetermined independently of the original.

17. An apparatus according to any one of claims 10–15, wherein said detecting means detects the densities from plural areas in a non-end portion, and wherein said control means determines the image forming condition on the basis of an average of the plural densities detected by said detecting means.

18. An apparatus according to any one of claims 10–15, wherein said control means determines the image forming condition for the end area in accordance with the density of a non-end area of the original detected by said detecting means.

19. An apparatus according to claim 18, wherein said control means determines the image forming condition for the end area in accordance with the image forming condition determined for a non-end area adjacent to the end area.

20. A copying apparatus, comprising:
a photosensitive member;
an original supporting member having an index to which a leading edge of the original is placed;
a light reflecting member for optically blocking said photosensitive member from a leading end portion of the original which is positioned to the index of said original supporting member;
illuminating means for illuminating the original, the illuminating means being movable relatively to the original for scanning the same and scanning said reflecting member prior to scanning the original;
optical means for directing the light reflected by said reflecting member and by the original to said photosensitive member;
means for developing a latent image formed on said photosensitive member;
means for detecting density of the original; and means for progressively controlling an image forming condition corresponding to an area of the original in a first manner using the area of the original detected by said detecting means, except for a boundary region between the original and said light reflecting member, and for controlling the image forming condition for the boundary area in a second manner which is different from said first manner, and which does not use the detected density at said end area.

21. An apparatus according to claim 20, wherein the image forming condition for the boundary region is matched to characteristics of said reflecting member.

22. An apparatus according to claim 20, wherein the image forming condition for the boundary region is predetermined independently of the original supported on said original supporting member.

23. An apparatus according to claim 20, wherein the image forming condition for the boundary region is predetermined independently of the original.

24. An apparatus according to claim 20, wherein the image forming condition for the boundary region is a developing parameter determined by said control means with respect to a part of the original adjacent to the boundary region.

25. An apparatus according to claim 20, wherein said control means determines the image forming condition for the boundary region in accordance with the density of the non-end area of the original detected by said detecting means.

26. An apparatus according to claim 20, wherein the image forming condition is a developing condition of said developing means.

* * * * *

UNITED STATES PATENT AND TRADEMARK OFFICE

CERTIFICATE OF CORRECTION

PATENT NO. : 4,745,434

DATED : May 17, 1988

INVENTOR(S) : YOSHINOBU SHIMOMURA, ET AL.

It is certified that error appears in the above-identified patent and that said Letters Patent is hereby corrected as shown below:

COLUMN 1

Line 67, "illustrates" should read --illustrate--.

COLUMN 3

Line 14, "end of" should read --end in--.

COLUMN 4

Line 15, "correct" should read --corrects--.
Line 47, "microswiches" should read --microswitches--.

COLUMN 6

Line 52, "half" should read --half---.

COLUMN 7

Line 6, "a" should be deleted.
Line 31, "tranmmitted" should read --transmitted--.
Line 36, "is" (first occurrence) should be deleted.
Line 66, "zoom lens 104" should read --zoom lens 106--.

COLUMN 8

Line 10, "real time bases" should read --real-time basis--.
Line 60, "controls" should read --controlling--.

UNITED STATES PATENT AND TRADEMARK OFFICE

CERTIFICATE OF CORRECTION

PATENT NO. : 4,745,434

DATED : May 17, 1988

INVENTOR(S) : YOSHINOBU SHIMOMURA, ET AL.

It is certified that error appears in the above-identified patent and that said Letters Patent is hereby corrected as shown below:

COLUMN 9

Line 15, "is" should read --being--.
Line 31, "purpoes" should read --purpose--.
Line 47, "qeuncy" should read --quency--.

COLUMN 10

Line 28, "O=0.76)" should read --Q=0.76)--.
Line 46, "decreae" should read --decrease--.
Line 57, "real time bases" should read --real-time basis--.

COLUMN 11

Line 32, "are" should read --area--.

UNITED STATES PATENT AND TRADEMARK OFFICE

CERTIFICATE OF CORRECTION

PATENT NO. : 4,745,434

DATED : May 17, 1988

INVENTOR(S) : YOSHINOBU SHIMOMURA, ET AL.

It is certified that error appears in the above-identified patent and that said Letters Patent is hereby corrected as shown below:

COLUMN 12

Lines 29-30, "wherein the image forming condition is a developing condition of" should read --wherein the developing condition is a developing bias potential applied to--.

Signed and Sealed this

Seventh Day of March, 1989

*Attest:*

DONALD J. QUIGG

*Attesting Officer*

*Commissioner of Patents and Trademarks*